US008894109B2

(12) United States Patent
Kindig

(10) Patent No.: US 8,894,109 B2
(45) Date of Patent: Nov. 25, 2014

(54) REPLACEMENT DOOR HANDLE FOR VEHICLE

(71) Applicant: Kindig-It Designs, Inc., Salt Lake City, UT (US)

(72) Inventor: David R. Kindig, Salt Lake City, UT (US)

(73) Assignee: Kindig-It Design, Inc., Salt Lake City, UT (US)

( * ) Notice: Subject to any disclaimer, the term of this patent is extended or adjusted under 35 U.S.C. 154(b) by 0 days.

(21) Appl. No.: 14/043,669

(22) Filed: Oct. 1, 2013

(65) Prior Publication Data

US 2014/0035300 A1 Feb. 6, 2014

Related U.S. Application Data

(63) Continuation of application No. 12/917,263, filed on Nov. 1, 2010, now Pat. No. 8,544,904.

(60) Provisional application No. 61/256,486, filed on Oct. 30, 2009.

(51) Int. Cl.

| | |
|---|---|
| ***E05B 3/00*** | (2006.01) |
| ***E05B 85/10*** | (2014.01) |
| ***E05B 85/14*** | (2014.01) |
| *E05B 1/00* | (2006.01) |

(52) U.S. Cl.

CPC ..... *E05B 85/103* (2013.01); *E05B 85/14* (2013.01); *Y10S 292/31* (2013.01)

USPC ..... 292/336.3; 292/DIG. 31

(58) Field of Classification Search

USPC ..... 292/336.3, DIG. 31

See application file for complete search history.

(56) References Cited

U.S. PATENT DOCUMENTS

| | | | | |
|---|---|---|---|---|
| 892,080 | A | 6/1908 | Pishek | |
| 1,995,338 | A | 3/1935 | Andrews | |
| 2,201,444 | A | 5/1940 | Marsh | |
| 2,208,818 | A | 7/1940 | Schaffler | |
| 2,610,080 | A * | 9/1952 | Jakeway | 292/336.3 |
| 2,649,322 | A | 8/1953 | Mack | |
| 3,020,075 | A | 2/1962 | Johnstone et al. | |
| 3,153,552 | A | 10/1964 | Sandor | |

(Continued)

FOREIGN PATENT DOCUMENTS

| | | |
|---|---|---|
| EP | 0147129 | 7/1985 |
| EP | 0072537 | 4/1987 |

(Continued)

*Primary Examiner* — Carlos Lugo

(74) *Attorney, Agent, or Firm* — Morris O'Bryant Compagni, PC

(57) ABSTRACT

A flush mounted, vehicle door handle includes a housing having an outer wall defining an interior recess and a handle pivotally coupled to the housing. A first portion of the handle is configured for pressing on a first side of a fulcrum and a second portion of the handle is configured for puffing on a second side of the fulcrum. The handle is disposed within the interior recess of the housing when positioned in a first, resting position. The first portion of the door handle has a back surface provided for actuating a door latch mechanism of an existing vehicle door when the housing is mounted to a door panel of a vehicle. Thus, when the handle is pivoted about the fulcrum to a second position, the door latch mechanism is actuated causing the door latch mechanism to release the automobile door allowing the door to open.

32 Claims, 7 Drawing Sheets

(56) References Cited

U.S. PATENT DOCUMENTS

| | | | | |
|---|---|---|---|---|
| 3,153,553 | A | 10/1964 | Sandor | |
| 3,266,275 | A | 8/1966 | Atkinson | |
| 3,508,778 | A | 4/1970 | Legge et al. | |
| 3,528,695 | A | 9/1970 | Peters | |
| 3,544,148 | A | 12/1970 | Sandor | |
| 3,590,609 | A | 7/1971 | Atkinson | |
| 3,908,149 | A | 9/1975 | Gergoe et al. | |
| 4,412,696 | A | 11/1983 | Ishii et al. | |
| 4,580,821 | A | 4/1986 | Genord, Jr. et al. | |
| 4,588,219 | A | 5/1986 | Kobayashi et al. | |
| 4,703,963 | A | 11/1987 | Ball | |
| 5,282,657 | A | 2/1994 | Clinch et al. | |
| 5,301,989 | A * | 4/1994 | Dallmann et al. | 292/142 |
| 5,496,078 | A | 3/1996 | Yasuda | |
| 5,887,918 | A | 3/1999 | Okada et al. | |
| 6,095,573 | A * | 8/2000 | Rozema | 292/51 |
| 6,370,744 | B1 | 4/2002 | Mendez | |
| 6,598,913 | B2 | 7/2003 | Meinke | |
| 6,698,262 | B2 * | 3/2004 | Wittwer | 70/208 |
| 6,923,481 | B2 | 8/2005 | Bruderick et al. | |
| 6,971,689 | B2 | 12/2005 | Jackson | |
| 7,552,954 | B2 | 6/2009 | Rozo et al. | |
| 7,621,573 | B2 | 11/2009 | Thomas et al. | |
| 7,798,540 | B1 | 9/2010 | Vitry et al. | |
| 8,544,904 | B2 * | 10/2013 | Kindig | 292/336.3 |
| 2008/0018120 | A1 | 1/2008 | Bailey et al. | |
| 2008/0163555 | A1 | 7/2008 | Thomas et al. | |

FOREIGN PATENT DOCUMENTS

| | | | |
|---|---|---|---|
| WO | 02092947 | | 11/2002 |
| WO | 2006010649 | A1 | 2/2006 |
| WO | 2007134983 | A1 | 11/2007 |

* cited by examiner

REPLACEMENT DOOR HANDLE FOR VEHICLE

CROSS-REFERENCE TO RELATED APPLICATION

This application is a continuation of U.S. patent application Ser. No. 12/917,263, filed on Nov. 1, 2010, now U.S. Pat. No. 8,544,904, which claims priority to U.S. Provisional Application Ser. No. 61/256,486, filed on Oct. 30, 2009, the entirety of each of which is incorporated by this reference.

BACKGROUND

1. Field of the Invention

The present invention relates generally to door handles for automobiles and more specifically, to replacement door handles for automobiles that, when installed, are recessed into the surface of the door.

2. State of the Art

Many door handles for vehicles, including both cars and trucks, manufacturing during the 1950s, '60s and '70s, especially those manufactured by General Motors, protruded from the surface of the door panel and included a push button for actuating a door latching mechanism. Depressing the push button caused the latching mechanism to be released to allow the door to open.

U.S. Pat. No. 3,908,149 to Gergoe et al. discloses a conventional push button type door handle assembly for a vehicle, the entirety of which is incorporated by this reference. As shown in FIG. 1, a door handle assembly 16 includes a handle 18 that can be manually grasped to pull the door 12 open subsequent to unlatching of a door lock as well as a push button 20 that is manually depressed to unlatch the door lock. The operation of the door handle assembly 16 proceeds by a person depressing the push button 20 which causes the push rod 32 to move the unlatching member 60 which in ire turn unlatches the door lock.

Today, vehicle door latches on practically all vehicles are usually operated by use of a handle which requires the user to pull, lift, or tug, i.e., an outward force rather than a pushing force. There is a reason for this. The unfortunate side effect of the push button design was that external objects which touched a vehicle during a collision, spinout or rollover could trigger the latch, causing the door to pop open and eject the vehicle occupants. A death which occurred exactly that way led to the landmark legal case of Daly v. General Motors Corp., 20 Cal. 3d 725 (1978).

Many of these older vehicles have become quite collectable. Often times, however, restoration of the vehicle is necessary in order to return the vehicle to operating condition. In addition, rather than sire ply replacing non-working components with reproductions that are of similar construction to the original, it is often desirable to customize the vehicle with replacement parts that give a more custom look. It is further desirable to provide such replacement parts that increase the safety of the vehicle with newer components that provide incorporate more modern safety features.

SUMMARY OF THE INVENTION

Accordingly, the present invention overcomes many of the deficiencies and disadvantages of prior art door handles by providing a replacement door handle assembly that gives a custom. Flush mounted appearance to the door and also that provides a safer door handle configuration.

A flush mounted, vehicle door handle includes a housing having an outer wall defining an interior recess and a handle pivotally coupled to the housing. A first portion of the handle is configured for pressing on a first side of a fulcrum and a second portion of the handle is configured for pulling on a second side of the fulcrum. The handle is disposed within the interior recess of the housing when positioned in a first, resting position. The first portion of the door handle has a back surface provided for actuating a door latch mechanism of an existing vehicle door when the housing is mounted to a door panel of a vehicle. Thus, when the handle is pivoted about the fulcrum to a second position, the door latch mechanism is actuated causing the door latch mechanism to release the automobile door allowing the door to open.

The housing of the door handle may include a first back plate coupled to a back side of the housing and positioned adjacent the second portion and a second back plate coupled to a back side of the handle and positioned adjacent to the first portion. The second back plate may be configured to move along with the handle when the handle is pivoted and the second back plate is configured to actuate a door latch mechanism of a vehicle.

In one embodiment, the housing may be comprised of a unitary wall having a contour configured to substantially match a contour of an outer perimeter of the handle.

In another embodiment, the first portion of the handle has a larger width than a corresponding width of said second portion of said handle and said fulcrum located proximately between said first portion and said second portion.

In still another embodiment, a handle mounting assembly includes a pair of mounting members, each attached at opposite sides of the housing. A handle mounting member is positioned between the pair of mounting members and is attached to a back side of the handle and pivotally coupled to the pair of mounting members.

In yet another embodiment, the pair of mounting members are attached to a back side of the housing.

In another embodiment, an elongate rod is coupled between the pair of mounting members and to the handle mounting member. The rod pivotally mounts the handle mounting member to the pair of mounting members such that the handle mounting member can pivot relative to the first and second mounting members about the rod.

In yet another embodiment, a biasing device is coupled to the handle mounting assembly to cause the handle to pivot to a dosed position when not being lifted relative to the housing.

In still another embodiment, a latch engagement structure is attached to a back side of the second back plate and configured for engaging a door latch mechanism of a vehicle door when the second back plate is moved away from the housing.

In another embodiment, a front side of the housing is configured to be flush mounted to a door panel of a vehicle door.

The door handle of the present invention can only be actuated by depressing the thumb portion of the handle to cause the grasping portion to raise away from the door panel a sufficient amount to allow the user to grasp the elongate grasping portion with the fingers and pull the door handle causing the handle to continue to rotate about a fulcrum in which the thumb portions continues to be forced inward, into the housing. As the thumb portion continues to move into the housing, the thumb portion causes the latch mechanism of the door assembly to open, thus allowing the door to open.

The foregoing advantages and characterizing features will become apparent from the following description of certain illustrative embodiments of the invention. The above-described features and advantages of the present invention, as well as additional features and advantages, will be set forth or will become ore fully apparent in the detailed description that follows and in the appended claims. The novel features which are considered characteristic of this invention are set forth in the attached claims. Furthermore, the features and advantages of the present invention may be learned by the practice of the invention, or will be obvious to one skilled in the art from the description, as set forth hereinafter.

BRIEF DESCRIPTION OF THE DRAWINGS

The following drawings illustrate exemplary embodiments for carrying out the invention. Like reference numerals refer to like parts in different views or embodiments of the present invention in the drawings.

DETAILED DESCRIPTION OF THE ILLUSTRATED EMBODIMENTS

Those of ordinary skill in the art will realize that the following description of the present invention is illustrative only and not in any way limiting. Other embodiments of the invention will readily suggest themselves to such skilled persons.

Figure 1:
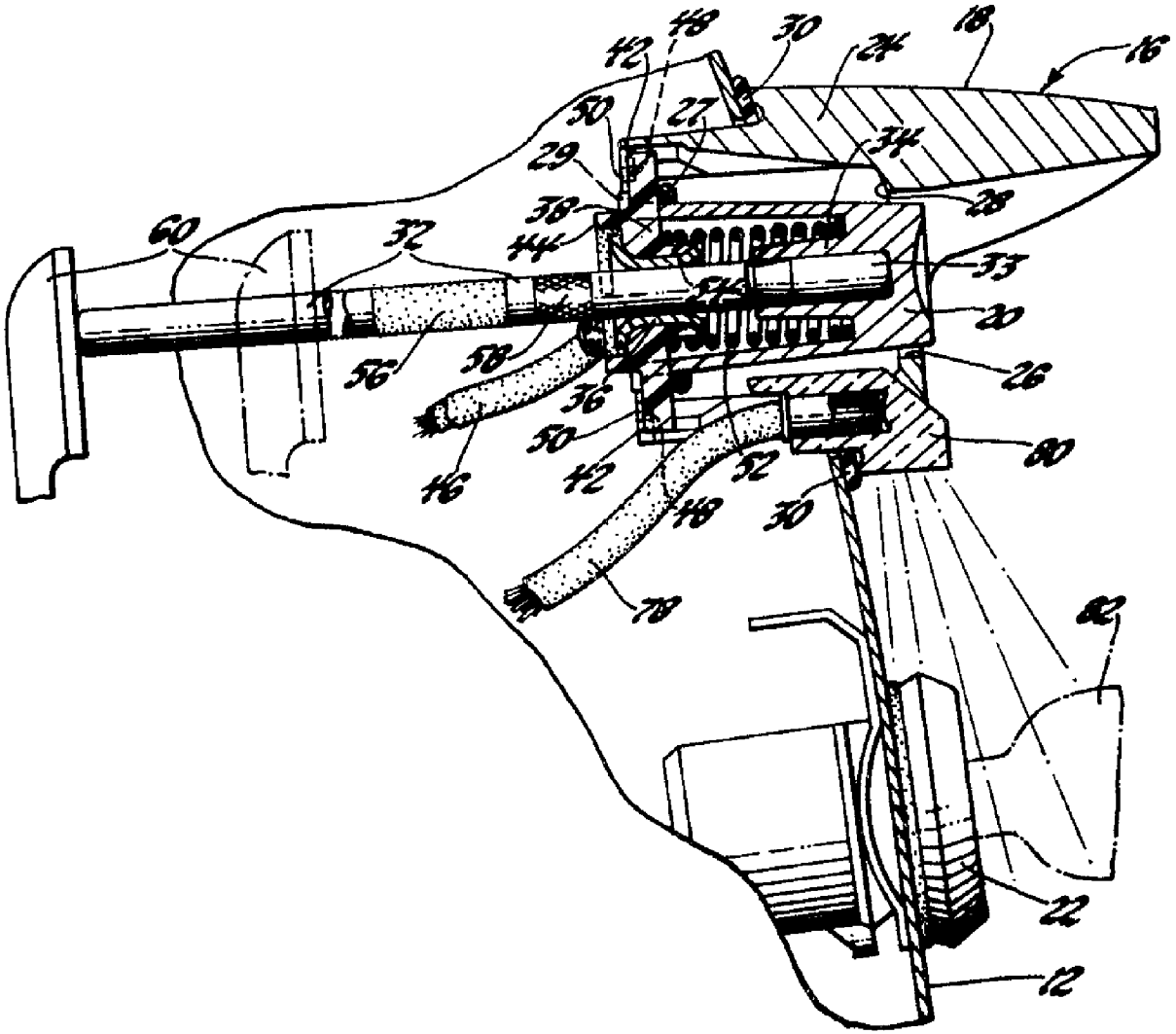
FIG. 1 (PRIOR ART)
FIG. 1 is a perspective front side view of a prior art door handle for a vehicle.
Figure 2:
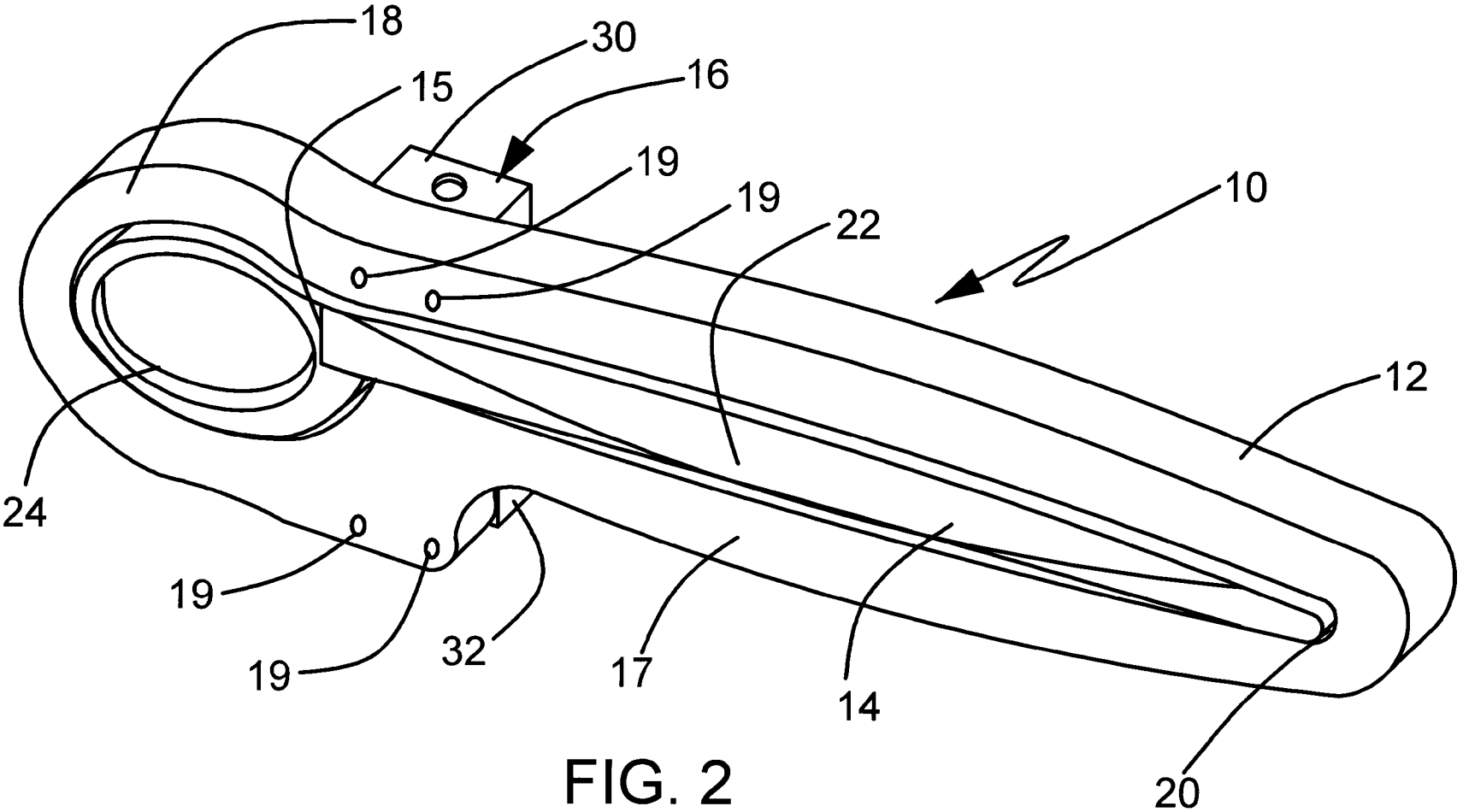
FIG. 2 is a perspective front side view of a vehicle door handle assembly according to the principles of the present invention.

FIG. 2 illustrates a first embodiment of door handle assembly, generally indicated at 10 in accordance with the principles of the present invention, configured to replace an existing push-button type door handle as was common in vehicles from the 1950s, '60s and '70s. The door handle 10 is comprised of an outer housing 12 and a handle 14 that is pivotally coupled to the housing 12 with a handle attachment assembly 16. The handle attachment assembly includes mounting members 30 and 32 in the form of rectangular blocks that are fastened to the housing 12 as with threaded fasteners through holes 19. The outer housing 12 has an outer wall 17 that defines a front surface 18 that is configured to be flush mounted to a door panel (not shown) and defines an interior chamber, channel, recess or space 20 that runs substantially the length of the housing 12, is defined by the outer wall 17 and is configured for receiving the handle 14 at least partially therein. Thus, when attached relative to the housing 12, the handle 14 fits within the recess 20 in the housing 12 when positioned in a resting (i.e., closed) position as illustrated in FIG. 1.

The handle 14 includes an elongated grasping portion 22 that extends along a length of the housing 18 and a larger "thumb" portion 24 at one end 15 thereof configured for pressing, as with a thumb. The handle 14 is pivotally coupled to the housing 12 so that a fulcrum or pivot point lies between the thumb portion 24 and the grasping portion 22. When pressing the larger portion 24, the portion of the recess 20 surrounding the thumb portion 24 has a larger depth that allows the larger portion 24 to move into the recess 20 thereby causing the grasping portion 22 to pivot outwardly and away from the housing 12 until a user can grasp the elongated grasping portion 22. Once grasped by the user, continued pulling on the elongated grasping portion 22 causes the door handle 10 to engage a door latching mechanism of the vehicle door (not shown) to be released and allows the user to swing the door of the vehicle to an open position. The door handle 14 is biased, as by a spring, into its recessed resting position as illustrated in FIG. 2 so that when the handle 22 is released after the automobile door has been opened, the handle 14, and more specifically, the grasping portion 22, will automatically pivot back into the recess 20. The portion of the recess 20 underlying the grasping portion 22 may have a depth that is less than a depth of the portion underlying the thumb portion 24 to allow the thumb portion to pivot into the recess while causing the grasping portion 22 to pivot back into the recess 20 to a point where the handle grasping portion is substantially flush mounted relative to the housing 12. There can be various ways to accomplish this by changing the thickness of portions of the handle 14 to create more space between the handle 14 between the thumb portion 24 and the surface of the housing in the recess 20 beneath the thumb portion than there is between all or a portion of the grasping portion 22 and the portion of the housing in the recess 20 that is beneath the grasping portion 22.

Figure 3:
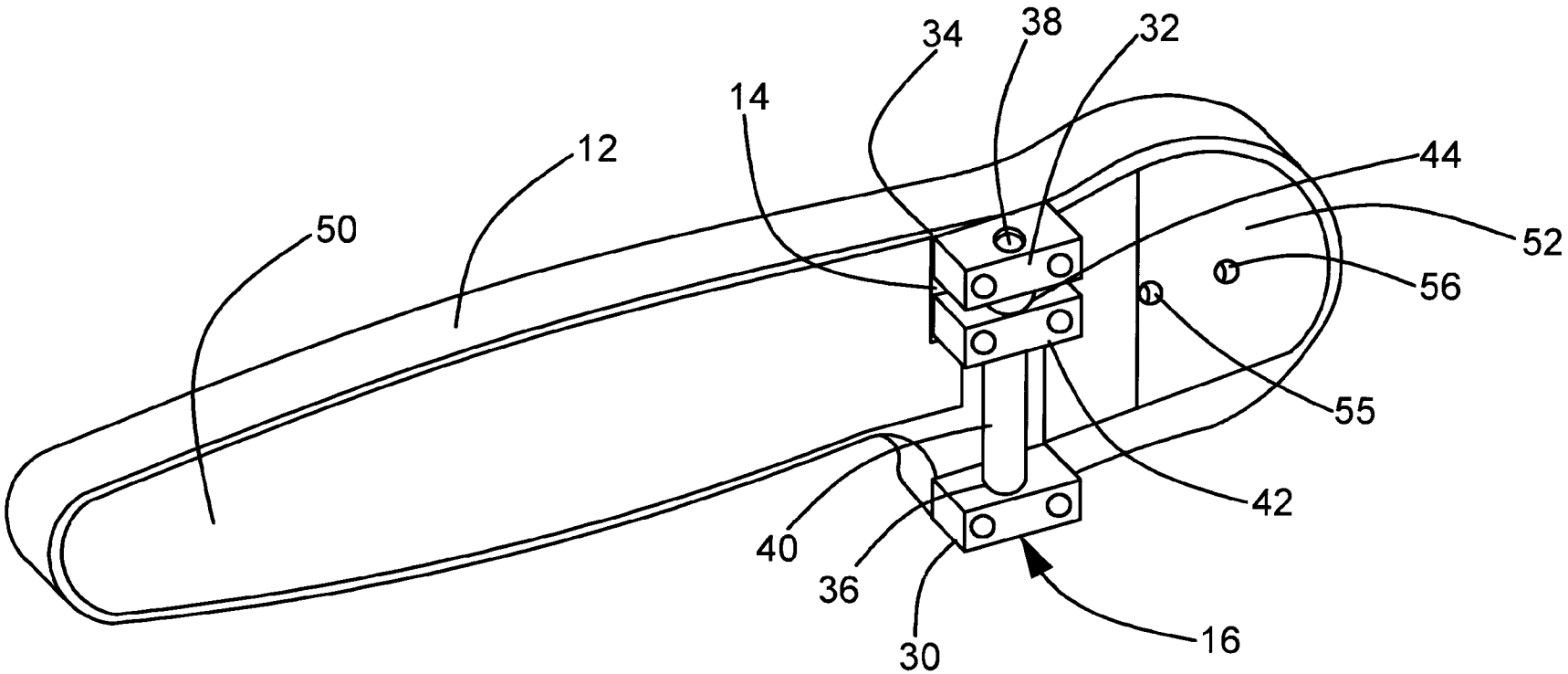
FIG. 3 is a perspective back side view of the vehicle door handle assembly illustrated in FIG. 2.

As show in FIG. 3, the handle attachment assembly 16 is comprised of a pair of mounting members 30 and 32 that are fixedly coupled to the back 34 of the housing 12. The mounting members 30 and 32 may be attached to the housing with threaded fasteners, by welding or other methods known in the art. The mounting members 30 and 32 are provided with transversely extending bores 36 and 38, respectively, for receiving a cylindrical rod 40. A similar handle mounting member 42 is fixedly coupled to the back of the handle 14 and is also provided with a transversely extending bore 44 through which the rod 40 passes. The bore 44 of the handle mounting member 42 may be slightly larger in diameter than a diameter of the rod 40 so that the mounting member 42 can pivot thereon, thus allowing the handle 14 to pivot therewith relative to the housing 12.

A pair of back plates 50 and 52 is provided that covers the back side of the housing 12. The back plate 50 is fixedly attached to the back of the housing 12 and extends along the portion of the housing 12 where the grasping portion of the handle 14 lies. The back plate 50 serves as an abutment surface whereby the back of the grasping portion of the handle 14 rests upon the back plate 50 when the handle 14 is in a closed position. The back plate 52 is coupled to the back of the handle 14 as with threaded fasteners through apertures 55 and 56. The back plate 52 moves with the thumb portion 24 of the handle 14 when the handle 14 is pivoted to an open position. As will be described in more detail, the back plate 52 provides a contact surface or structure for engaging with a latch release mechanism of a vehicle door latch assembly.

Figure 4A:
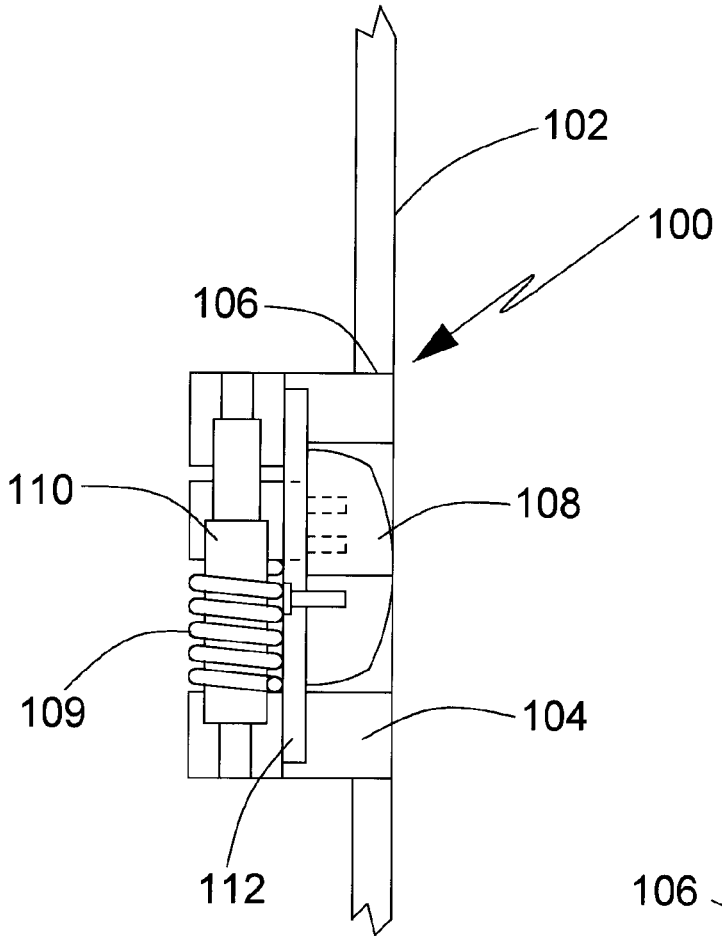
FIGS. 4A and 4B are side views of a vehicle door handle assembly according to the principles of the present invention with the door handle shown in FIG. 4A in a closed position and the door handle shown in FIG. 4B in an open position.
Figure 4B:
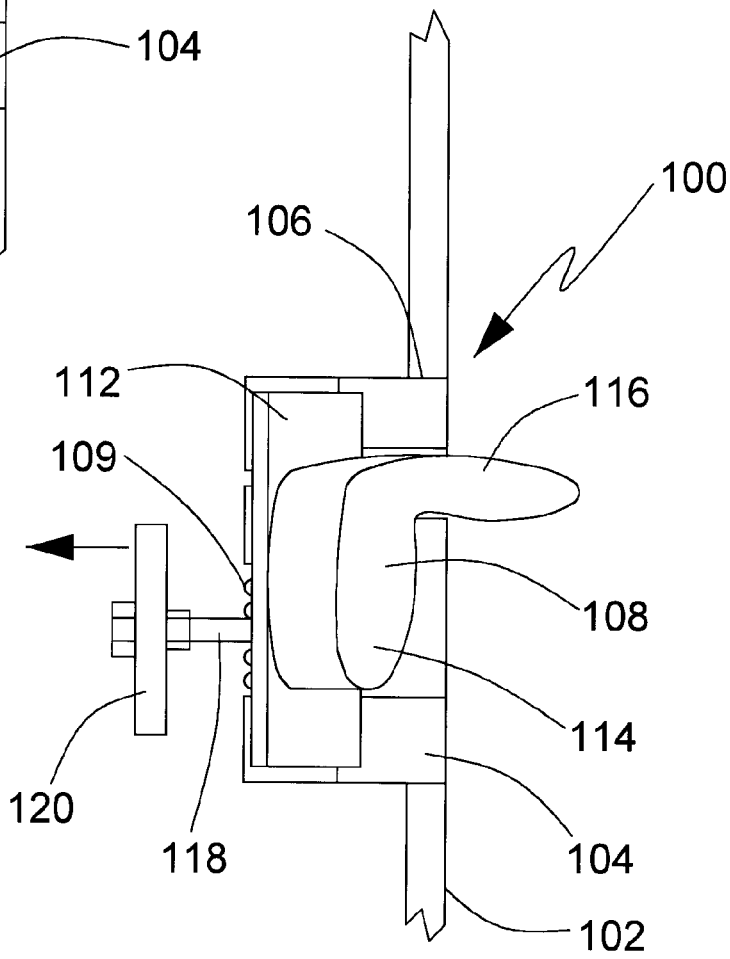

Referring now to FIGS. 4A and 4B, there is illustrated an embodiment of a door handle assembly, generally indicated at 100, according to the principles of the present invention. The door handle assembly 100 is flush mounted to the exterior door panel 102 of an automobile door 102. More specifically, the outer housing 104 is attached, as by welding, to a similarly shaped hole that is cut into the door 102. In a dosed position as illustrated in FIG. 4A, the handle 108 is biased in place with a coil spring 109 that extends around the shaft 110 and abuts at one end against the back of the back plate 112 and abuts at a second end against the back plate (not visible) that is positioned behind the grasping portion of the handle 108 as previously described.

As shown in FIG. 4B, as the thumb portion 114 of the handle 108 is depressed, the grasping portion 116 is outwardly pivoted to allow a user to grasp the handle 108. Because the back plate 112 is attached to the back of the handle 108, pivoting of the handle 108 causes the back plate 112 to move inwardly. Once the grasping portion 116 has moved far enough away from the outer surface of the door 102, the grasping portion 116 of the handle can be pulled away from the door 102. Doing so causes the back of the back plate 112 to contact a rod 118 extending from a latch release mechanism 120 of the vehicle thereby moving the latch release mechanism 120 in the direction of the arrow, which in turn causes the door latch to release allowing the door 102 to be pulled open by the handle 108. The rod 118 may be in the form of a threaded bolt that is attached to the latch release mechanism 102 as by drilling a hole in the latch release mechanism 120 and attaching a bolt and nut thereto, with the bolt serving as the rod 118. The rod 118 can be lengthened or shortened depending on the distance between the back plate and the latch release mechanism 120. The back plate 112 serves as a strike plate to engage the rod 118 and thus force the latch release mechanism 120 in the direction of the arrow. When the handle 108 is released, the spring 109 forces the back plate 112 back to the position illustrated in FIG. 4A.

Figure 5:
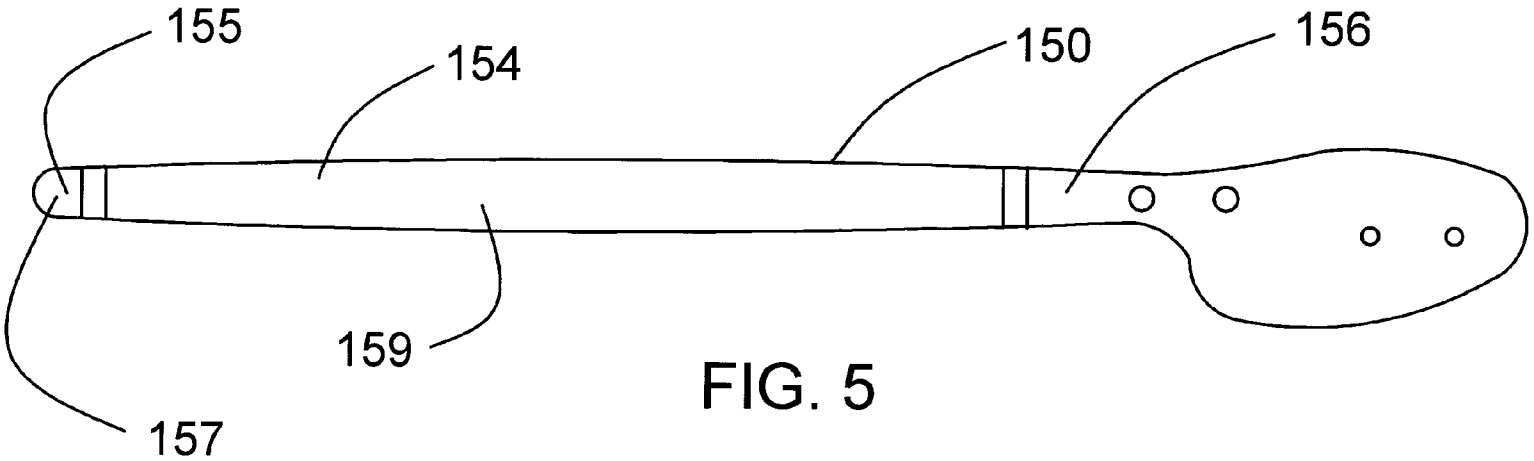
FIG. 5 is a back side view of a vehicle door handle according to the principles of the present invention.
Figure 6:
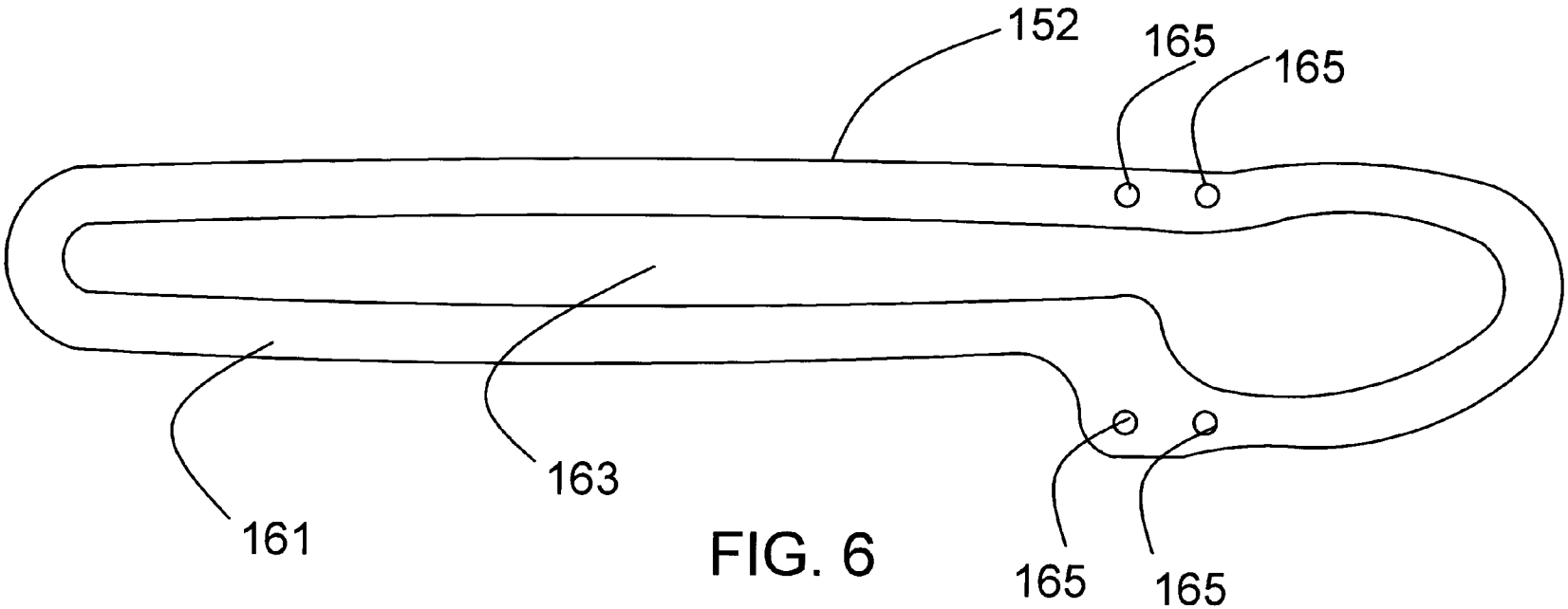
FIG. 6 is a front side view of a vehicle door handle housing according to the principles of the present invention.

As shown in FIGS. 5 and 6, while a handle 150 according to the present invention needs to be configured to be either a driver side or passenger side handle if manufactured in an asymmetrical form that requires a left side and a right side handle, the housing 152 can be configured to work on both sides of the vehicle. The handle 150 is provided with an elongate portion 154 along the grasping portion that is of a different elevation than at the ends 155 and 156 to allow a user to more easily grasp the handle. In addition, the raised end portion 155 provides an abutment surface 157 that rests upon the front surface of the back plate (previously described) when the handle is in a closed or resting position. Between these ends 155 and 156, the handle 150 has a thinner section 159 that provides a space between the back plate and the handle 150 along this thinner section 159. This cause the back of the handle 150 to be exposed and able to be grasped with less pivotal rotation of the handle 150 than if the back surface of the handle 150 was in a single plane. The housing 152 is comprised of a unitary outer perimeter wall 161 that may be formed by machining or casting processes known in the art that defines an interior aperture 163. The inner aperture 163 has a shape that matches an outer perimeter contour of a door handle according to the present invention, such as handle 150, and of a size that is slightly larger than the handle 150. Thus, in principle, a designer can design the shape of the handle for aesthetics with the housing being sized and shaped to match the particularly designed handle. Thus, while the various embodiments of the handles of the present invention have been shown to have a particular configuration with an enlarged thumb portion and an elongate grasping portion, the handle could have virtually any shape and be of any practical size.

The holes 165 for mounting the handle mounting structure and handle 150 to the housing 152 extend completely through the housing 152. As such, the handle mounting hardware can be attached to either side of the housing 152 to allow the same housing 152 to be used to mount either a passenger side or driver side handle. Moreover, if the design of the handle 150 is such that it is symmetrical about its longitudinal axis such that it could be mounted in both a top side up and top side down configuration and have the same appearance, as would be the case for example with a popsicle stick shape, a single handle could be mounted on either the passenger or driver side as well.

Figure 7:
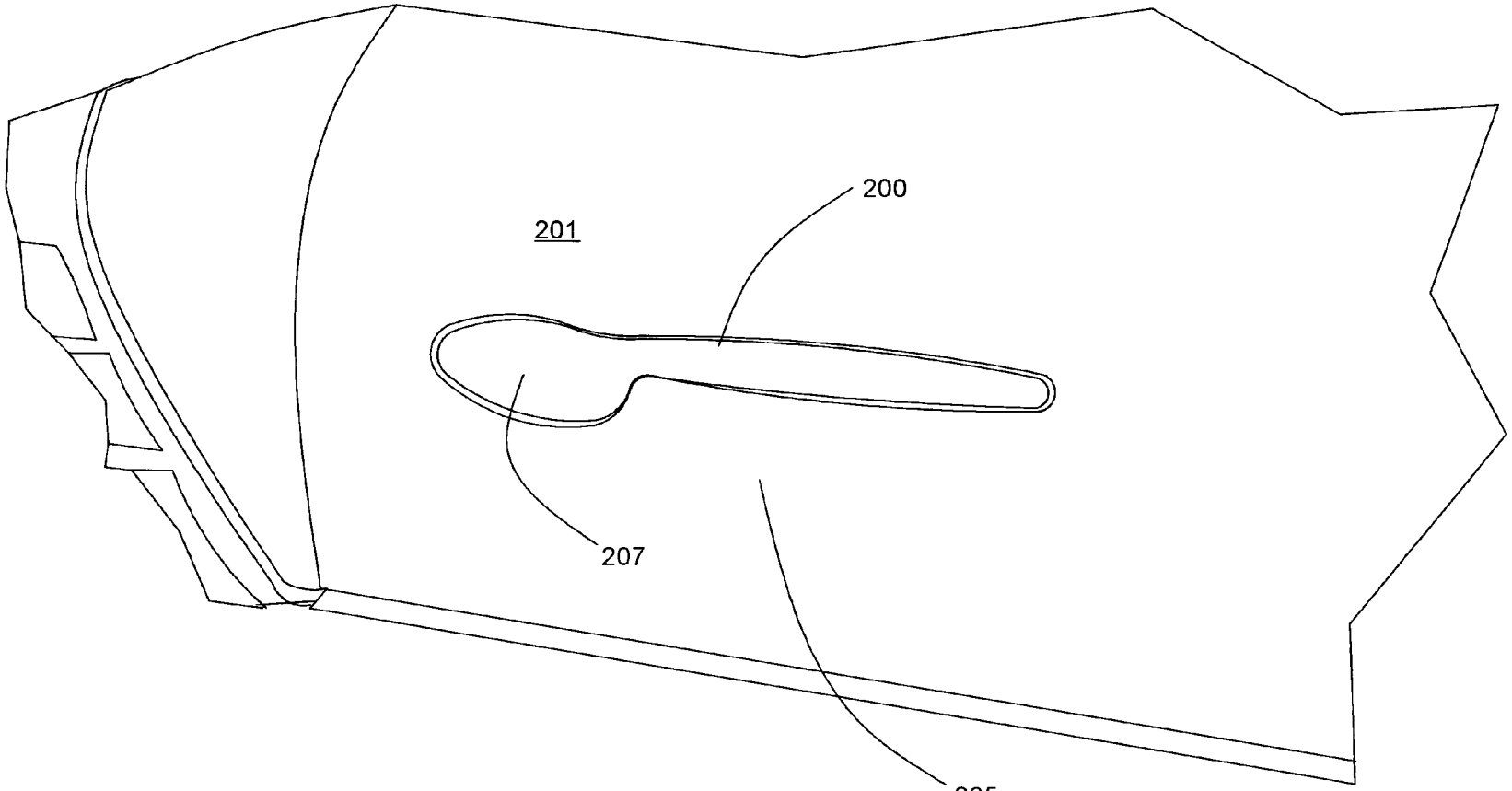
FIG. 7 is a front side view of a vehicle door handle assembly attached to a door of an automobile according to the principles of the present invention.
Figure 8:
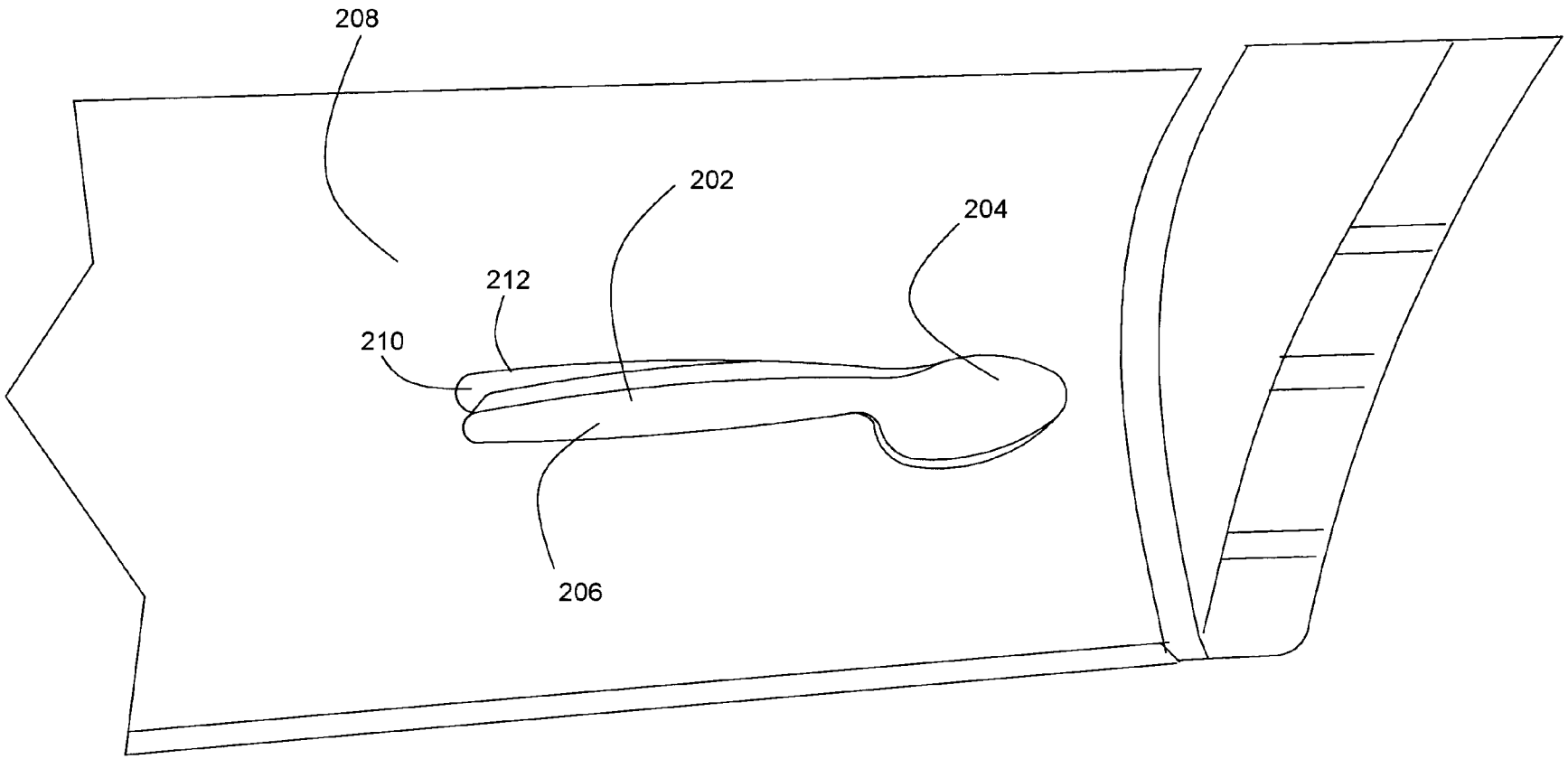
FIG. 8 is a front side view of a vehicle door handle assembly attached to a door of an automobile according to the principles of the present invention.

FIGS. 7 and 8 illustrate fully installed passenger and driver's-side door handles 200 and 202, respectively, in accordance with the principles of the present invention. As shown in FIG. 7, the handle 200 is essentially flush mounted so that, little, of any, of the handle 200 protrudes above the door surface 201 when the handle 200 is in a closed position as illustrated. To mount the door handle 200 to a car door, a hole is cut in the door panel 205 that is sized and shaped to substantially match the size and shape of the outer perimeter of the door handle housing of the present invention. The door handle housing is then attached to the door panel 205 as by welding the housing to the door panel. The thumb portion 207 is positioned over the component of the door latch mechanism that will cause the door to become unlatched when sufficiently pressed.

As shown in FIG. 8, pressing the handle 202 at the enlarged portion 204 of the handle 202 causes the elongated grasping portion to pivot away from the door panel and above and out of the recess 210 formed by the housing 212 as the enlarged portion 204 is forced into the door panel and the same recess 210. Simply pressing the handle 202 at the enlarged portion, however, is generally not sufficient to cause the door to open. Opening of the door, as is shown in FIG. 8, further requires that the elongate handle portion be pulled away from the door to further pivot the handle 202 thus causing the door latch mechanism (not shown) of the vehicle to be released and allowing the automobile door to open as shown. This provides a safety feature for the door handle assembly of the present invention. Specifically, in the case of an automobile accident in which an object, such as another vehicle, collides with the door 208. Pressing of the thumb portion alone may not be sufficient to cause the door to unlatch and open, especially since it is unlikely that the thumb portion 204 can be sufficiently pressed without also forcing the elongate portion 206 to be forced toward the recess 210.

Thus, the configuration of the door handles according to the present invention provide an additional safety benefit as compared to conventional push button-type door handles that they replace. As previously discussed herein, one of the known safety issues with push-button type door handles for automobiles was their potential for being inadvertently depressed during an automobile accident. Doing so could cause the door to open, allowing the occupants to be expelled from the vehicle, especially in rollover crashes. Because the handle of the present invention is recessed into the door panel, there is less chance that an impact along the door panel could cause the door handle to swing open to open the door. In addition, any impact at the location of the handle is likely to press against the elongate handle portion, thus preventing the door from opening.

A typical installation of a door handle to the door of a preexisting requires removal of the old door handle and cutting of the exterior door panel in a shape substantially similar to the shape of the outer housing of the door handle assembly of the present invention. The remaining door hardware for actuating the door latch mechanism of the vehicle is left in place. The component, (e.g., strike plate) that is configured to be pushed by the push button of the old door handle is drilled so as to receive a threaded fastener that will serve as a push rod. The length of the threaded fastener can be adjusted relative to the component to make sure that the new handle, once installed, will properly engage and move the component to open the door. The door handle of the present invention can be configured to replace various configurations and types of push-button type door handles from most vehicle manufacturers and can be installed with or without lock cylinders.

The outer housing is attached to the door panel at the location of the hole that has been cut. The outer housing can be attached by welding or otherwise mechanically attached as with a fastener or other methods known in the art. The welded area is then ground to produce a relatively smooth surface. A plastic body filler is then applied around the area and sanded to produce a smooth paintable surface. The handle can then be coupled to the housing with threaded fasteners in a manner previously described herein. The result is the look of a recessed door handle that adds to the aesthetics of the vehicle and gives the door a more custom appearance.

It will be apparent to those skilled in the art that some other configurations of a door handle assembly could be employed without departing from the inventive concepts herein. For example, the exact contour of the housing and handle can be modified into virtually any shape or size as may be desired. For example, the handle could be configured to have the same general cross-sectional size and shape along its entire length. Thus, while there have been described various embodiments of the present invention, those skilled in the art will recognize that other and further changes and modifications may be made thereto without department from the spirit of the invention, and it is intended to claim all such changes and modifications that fall within the true scope of the invention. The term "flush mounted" as used herein refers generally to door handles that are recessed at least partially within the door panel of a vehicle door and not necessarily to door handles that have an exposed surface that is planar with a plane defined by the door panel. In other words, flush mounted door handles can have portions that protrude from the surface of the door panel to some extent depending on the aesthetic look and feel desired. It is generally that the front face of the housing is substantially flush mounted to the door panel to be substantially co-planar therewith. It is also understood that, as used herein and in the appended claims, the singular forms "a," and "the" include plural reference, unless the context clearly dictates otherwise.

Unless defined otherwise, all technical and scientific terms used herein have the same meanings as commonly understood by one of ordinary skill in the art to which this invention belongs. While various methods and structures of the present invention are described herein, any methods or structures similar or equivalent to those described herein may be used in the practice or testing of the present invention. All references cited herein are incorporated by reference in their entirety and for all purposes. In addition, while the foregoing advantages of the present invention are manifested in the illustrated embodiments of the invention, a variety of changes can be made to the configuration, design and construction of the invention to achieve those advantages including combinations of components of the various embodiments. Hence, reference herein to specific details of the structure and function of the present invention is by way of example only and not by way of limitation.

What is claimed is:

1. A flush mounted, vehicle door handle for replacing an existing door handle of a vehicle, comprising:

a handle having a first elongate portion configured for grasping and lifting and a second portion configured for depressing;

a housing comprised of an outer wall defining an aperture having a contour similar to an outer contour of the handle, the first and second portions of the handle being at least partially received within the housing when the handle is positioned in a first, resting position;

a pivot assembly coupled to the housing proximately between the first portion and the second portion, the handle coupled to the pivot assembly with the first elongate portion on one side of a fulcrum of the pivot assembly and the second portion on the other side of the fulcrum;

a first back wall fixed to a back side of the housing and defining an abutment surface for limiting pivoting of the handle toward the housing such that a top surface of the handle is substantially flush with a top edge of the housing;

a second back wall coupled to a back side of the handle proximate the second portion having a contour to substantially match an interior contour of the housing along the second portion and covering a portion of the aperture proximate the second portion; and an abutment surface on a back of the second portion of the handle configured to engage and actuate a door latch mechanism of a vehicle door when the handle is pivoted about the pivoting assembly such that the first portion is at least partially lifted out of the housing and the second portion at least partially retreats into the housing.

2. The door handle of claim 1, wherein the second back wall is positioned adjacent the second portion, wherein the second back wall moves along with the handle when the handle is pivoted and wherein the second back wall is configured to actuate the door latch mechanism of the vehicle door.

3. The door handle of claim 1, wherein the outer wall comprises a unitary wall having a contour configured to substantially match a contour of an outer perimeter of the handle.

4. The door handle of claim 3, wherein the first portion of the handle is elongated for grasping with fingers of a user and the second portion is less elongated and wider than the first portion and is configured for pressing with a thumb of a user.

5. The door handle of claim 1, further comprising a pair of mounting members, each attached at opposite upper and lower sides of the housing, a handle mounting member positioned between the pair of mounting members attached to a back side of the handle and pivotally coupled to the pair of mounting members.

6. The door handle of claim 5, further comprising an elongate rod coupled between the pair of mounting members and to the handle mounting member, the rod mounting the handle mounting member to the pair of mounting members such that the handle mounting member can pivot relative to the first and second mounting members about the rod.

7. The door handle of claim 6, further comprising a biasing device coupled to the handle to cause the handle to pivot to the resting position when not being lifted relative to the housing.

8. The door handle of claim 1, further comprising a latch engagement structure attached to a back side of the second back wall and configured for engaging the door latch mechanism of the vehicle door when the second back wall is moved relative to the housing.

9. A method of replacing and existing door handle of a vehicle with a flush mounted, vehicle door handle, comprising:

removing an existing door handle from a vehicle door;

cutting a hole in a door panel of the vehicle door proximately where the existing door handle was located;

attaching a replacement handle assembly to the hole, the replacement handle assembly comprising;

a housing having an outer wall defining an aperture defining an inner contour of the outer wall;

a handle defining an outer contour and positioned at least partially within the aperture of the outer wall, the outer contour similar to the inner contour of the outer wall, the handle having a first elongate portion configured for grasping and lifting and a second portion configured for depressing;

a pivot assembly coupled to the housing, the handle coupled to the pivot assembly with the first portion of the handle on one side of a fulcrum of the pivot assembly and the second portion on the other side of the fulcrum of the pivot assembly;

a first back wall attached to a back side of the housing providing an abutment surface for limiting pivotal movement in one direction of the first portion of the handle relative to the housing such that a top surface of the handle is relatively flush with an outer surface of the door panel when the handle is in a resting position;

a second back wall coupled to a back side of the handle proximate the second portion having a contour similar to a portion of the inner contour of the outer wall proximate the second portion to cover a portion of the aperture proximate the second portion when the handle is in the resting position; and positioning the second back wall relative to a latch mechanism of the vehicle door so that when the handle is pivoted about the pivot assembly from the resting position to a second position the first portion is lifted out of the housing and the second portion and the second back wall inwardly pivot relative to the housing to release the latch mechanism so that the vehicle door can be opened.

10. The method of claim 9, further comprising welding the housing to the door panel of the vehicle door.

11. The method of claim 9, further comprising pivoting the handle about the fulcrum to the second position to actuate the door latch mechanism of the vehicle door thereby causing the door latch mechanism to release the vehicle door allowing the vehicle door to open.

12. The method of claim 9, further comprising providing the outer wall of the housing as a unitary wall.

13. The method of claim 9, further comprising grasping the first portion of the handle with fingers and depressing the second portion with a thumb.

14. The method of claim 9, further comprising attaching a pair of mounting members, to opposite upper and lower sides of the housing and attaching a handle mounting member between the pair of mounting members and to a back side of the handle to pivotally couple the handle mounting member to the pair of mounting members.

15. The method of claim 14, further comprising coupling an elongate rod between the pair of mounting members and to the handle mounting member, the rod mounting the handle mounting member to the pair of mounting members such that the handle mounting member can pivot relative to the first and second mounting members about the rod.

16. The method of claim 9, further comprising coupling a biasing device to the handle to cause the handle to pivot to the resting position when not being pivoted relative to the housing.

17. The method of claim 9, further comprising attaching a latch engagement structure to a back side of the second back wall for engaging the latch mechanism of the vehicle door when the second back wall is inwardly pivoted relative to the housing.

18. A method of replacing and existing door handle of a vehicle with a flush mounted, vehicle door handle, comprising:

removing an existing door handle from a vehicle door;

cutting a hole in a door panel of the vehicle door proximately where the existing door handle was located;

attaching a replacement handle assembly to the hole, the replacement handle assembly comprising;

a housing having an outer wall defining an aperture defining an inner countour of the outer wall;

a handle defining an outer contour and positioned at least partially within the aperture of the outer wall, the outer contour similar to the inner contour of the outer wall, the handle having a first elongate portion configured for grasping and lifting and a second portion configured for depressing;

a pivot assembly coupled to the housing, the handle coupled to the pivot assembly with the first portion of the handle on one side of a fulcrum of the pivot assembly and the second portion on the other side of the fulcrum of the pivot assembly;

a first back wall attached to a back side of the housing providing an abutment surface for limiting pivotal movement in one direction of the first portion of the handle relative to the housing such that a top surface of the handle is relatively flush with an outer surface of the door panel when the handle is in a resting position;

a second back wall coupled to the second portion and covering at least a portion of the aperture, wherein the second back wall moves along with the handle when the handle is pivoted; and positioning the second back wall relative to a latch mechanism of the vehicle door so that when the handle is pivoted about the pivot assembly from the resting position to a second position the first portion is lifted out of the housing and the second portion and the second back wall inwardly pivot relative to the housing to release the latch mechanism so that the vehicle door can be opened.

19. The method of claim 18, further comprising providing the outer wall of the housing as a unitary wall.

20. The method of claim 18, further comprising attaching a pair of mounting members, to opposite upper and lower sides of the housing and attaching a handle mounting member between the pair of mounting members and to a back side of the handle to pivotally couple the handle mounting member to the pair of mounting members.

21. The method of claim 20, further comprising coupling an elongate rod between the pair of mounting members and to the handle mounting member, the rod mounting the handle mounting member to the pair of mounting members such that the handle mounting member can pivot relative to the first and second mounting members about the rod.

22. The method of claim 18, further comprising coupling a biasing device to the handle to cause the handle to pivot to the resting position when not being pivoted relative to the housing.

23. The method handle of claim 18, further comprising attaching a latch engagement structure to a back side of the second back wall for engaging the latch mechanism of the vehicle door when the second back wall is inwardly pivoted relative to the housing.

24. A vehicle door handle for replacing an existing door handle of a vehicle, comprising:

a handle having a first elongate portion configured for grasping and lifting and a second portion configured for depressing;

a housing comprised of an outer wall defining an aperture defining an inner contour of the outer wall similar to an outer contour of the handle, the first and second portions of the handle being at least partially received within the housing when the handle is positioned in a resting position;

a pivot assembly coupled to the housing proximately between the first portion and the second portion, the handle coupled to the pivot assembly with the first elongate portion on one side of a fulcrum of the pivot assembly and the second portion on the other side of the fulcrum;

a first back wall attached to the housing providing an abutment surface for limiting pivotal movement in one direction of the first portion of the handle relative to the housing;

a second back wall coupled to the second portion and covering at least a portion of the aperture, wherein the second back wall moves along with the handle when the handle is pivoted; and an abutment on a back of the second portion of the handle configured to engage and actuate a door latch mechanism of a vehicle door when the handle is pivoted about the pivoting assembly and the second portion at least partially retreats into the housing.

25. The door handle of claim 24, wherein an outer surface of the handle is substantially flush with a top edge of the housing.

26. The door handle of claim 24, wherein the second back wall is positioned adjacent the second portion, wherein the second back wall moves along with the handle when the handle is pivoted and wherein the second back wall is configured to actuate the door latch mechanism of the vehicle door.

27. The door handle of claim 24, wherein the outer wall of the housing comprises a unitary wall.

28. The door handle of claim 24, wherein the first portion of the handle is elongated for grasping with fingers of a user and the second portion is less elongated and wider than the first portion and is configured for pressing with a thumb of a user.

29. The door handle of claim 24, further comprising a pair of mounting members, each attached at opposite upper and lower sides of the housing, a handle mounting member positioned between the pair of mounting members attached to a back side of the handle and pivotally coupled to the pair of mounting members.

30. The door handle of claim 29, further comprising an elongate rod coupled between the pair of mounting members and to the handle mounting member, the rod mounting the handle mounting member to the pair of mounting members such that the handle mounting member can pivot relative to the first and second mounting members about the rod.

31. The door handle of claim 24, further comprising a biasing device coupled to the handle to cause the handle to pivot to the resting position when not being lifted relative to the housing.

32. The door handle of claim 24, further comprising a latch engagement structure attached to a back side of the second back wall and configured for engaging the door latch mechanism of the vehicle door when the second back wall is pivoted relative to the housing.

* * * * *